US005457291A

United States Patent [19]

Richardson

[11] Patent Number: 5,457,291

[45] Date of Patent: Oct. 10, 1995

[54] SOUND-ATTENUATING PANEL

[76] Inventor: Brian E. Richardson, 3445 Oakwood Ct., Morgan Hill, Calif. 95037

[21] Appl. No.: 199,466

[22] Filed: Feb. 22, 1994

Related U.S. Application Data

[63] Continuation of Ser. No. 835,230, Feb. 13, 1992, abandoned.

[51] Int. Cl.[6] ..... E04B 1/82

[52] U.S. Cl. ..... 181/293; 181/294

[58] Field of Search ..... 181/285, 286, 181/288, 293, 290, 295, 294

[56] References Cited

U.S. PATENT DOCUMENTS 1,554,179 9/1925 Trader ..... 181/293
1,825,770 10/1931 Barnett ..... 181/293
3,159,236 12/1964 Akerson ..... 181/292
3,275,101 9/1966 Morrissey et al. ..... 181/293

*Primary Examiner*—Khanh Kang
*Attorney, Agent, or Firm*—Eppa Hite

[57] ABSTRACT

Acoustic resonator means are embodied through successive stages of molding. A first stage pre-forms resonator enclosures without solid forms inside. After resonator enclosures have been pre-formed they advance to a second stage. A jig form molds pre-formed resonator bulbs and concrete together in a panel molding region to form a resonator panel.

7 Claims, 3 Drawing Sheets

SOUND-ATTENUATING PANEL

This application is a continuation of application Ser. No. 07/835,230, filed Feb. 13, 1992 now abandoned.

BACKGROUND OF THE INVENTION

1. Technical Field

The present invention relates to acoustics and more specifically to sound barrier structures.

2. Prior Art

Sound barrier walls typically used along highways have flat surfaces which simply reflect noise with limited change. Sound barriers with three dimensional surfaces have greater potential for controlling noise. Complex baffle and resonator structures for example are well-known in acoustic chamber applications. Several U.S. patents disclosing sound barriers are reviewed in Applicant's co-pending application Ser. No. 07/705,587, now abandoned, which is incorporated herein by reference.

Referring to FIG. 1, a conventional Helmholtz resonator R has a hollow cavity C of volume V mostly surrounded by inside surface S of enclosure E. Interior cavity C communicates by a proportionally dimensioned port P through an opening of diameter D and length L on axis T to the exterior of enclosure E.

Acoustic resonators R are conventionally molded around a given volume V defined by a convex outside surface of a rigid solid interior form (not shown).

Conventionally, molding media mass is supported around rigid forms. After molding a medium outside, any solid rigid forms left inside need to be removed to embody a resonator R. Interior form removal may be possible only in pieces through a port compromised to a larger than preferred diameter D.

Cavity volumes V can as well be defined on the exterior of a molding medium using rigid forms with concave inside surfaces. If external pressures can be neglected or controlled during molding, then a cavity C interior does not need support by a form.

For example, in blow molding, a fluid (e.g., air) pressure on an inside surface of a sheet of plastic overcomes a lower pressure on its outside surface of the plastic confronted by a rigid exterior form. Biased pressures on the sheet plastic distends outward to, and through a port hole entrance into, the form. A resonator cavity opening inflates inside to conform the plastic surface to bulb molding surfaces on the inside of the rigid form.

Obstacles such as these constrain the economy of using acoustic resonators more widely as noise barriers. Thus, there remains a need for improved techniques of constructing sound barriers.

SUMMARY OF THE INVENTION

A primary object of the invention is to provide an efficient means for attenuating sound. Another object is to provide durable and weather resistant means for suppressing noise. A further object is to provide large area panels for noise-barriers. An additional object is to mold resonators without using solid forms inside cavities.

Acoustic resonator panels according to the invention are preferably embodied through two stages of molding. A first stage pre-forms resonator bulbs without having solid forms inside. In a second stage, the pre-formed resonator bulbs and concrete are molded together to form a sound-attenuating panel.

The invention's advantages are made increasingly apparent in the following Detailed Description and accompanying Drawing.

BRIEF DESCRIPTION OF THE DRAWING FIGURES

DETAILED DESCRIPTION OF THE INVENTION

The present invention forms sound-attenuating panels by molding a medium such as concrete around acoustic resonators. In a first stage a Helmholtz resonator is pre-formed as a bulb enclosing a volume of space without using a solid rigid form. The hollow bulb material may be formed through mechanical, thermal, chemical, electrolytic, magnetic or other applicable instrumentalities. A plastically-moldable medium of, for example, metal, glass or polymer plastic can be blow-molded or roto-molded into a bulb using a rigid form on only the exterior of the bulb.

Figure 5:
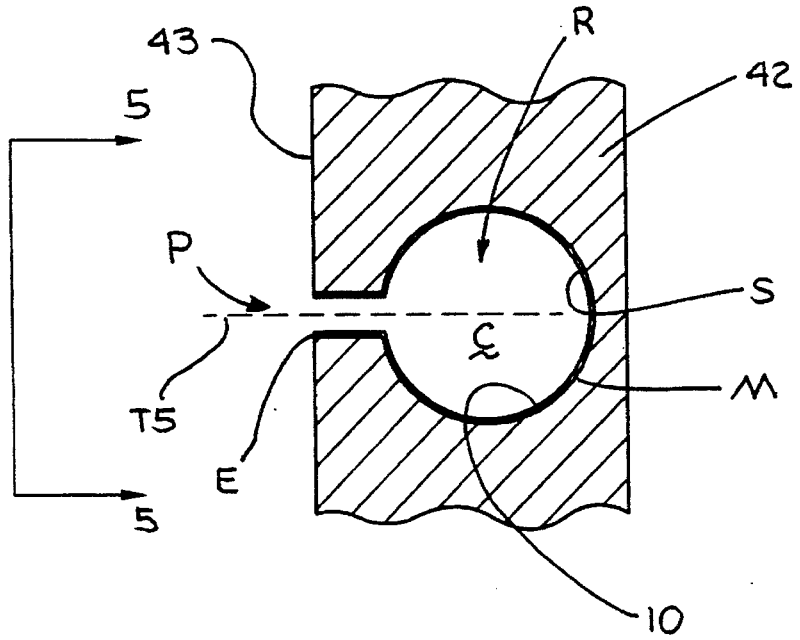
FIG. 5 is a view along arrow 45 in FIG. 4 with a resonator opening on axis T5 through cross-section plane 5—5.

Preferably, resonator bulbs are blow-molded by fluid (e.g., air) pressures unbalanced on inside and outside surfaces of a thin moldable sheet of plastic. Pressure biased outward on the sheet distends plastic toward and into an entrance hole to a passage within, a rigid exterior form. Plastic flows along the passage surrounded by a cylindrical port-form molding surface. The passage opens into a bulb cavity-form space surrounded by a bulb cavity-form molding surface. The molding surfaces anticipate the shape of concrete to be molded around molding surfaces on the outside the bulb later as shown in FIG. 5.

Pressure inflates the plastic and spreads its surface through the form space. The resonator opening expands until plastic fills the form space entirely to the molding surfaces. The resonator opening inside surface conforms within a tolerance to the contour of the molding surfaces. While conforming, the plastic hardens and its shape is fixed as a bulb.

Figure 1:
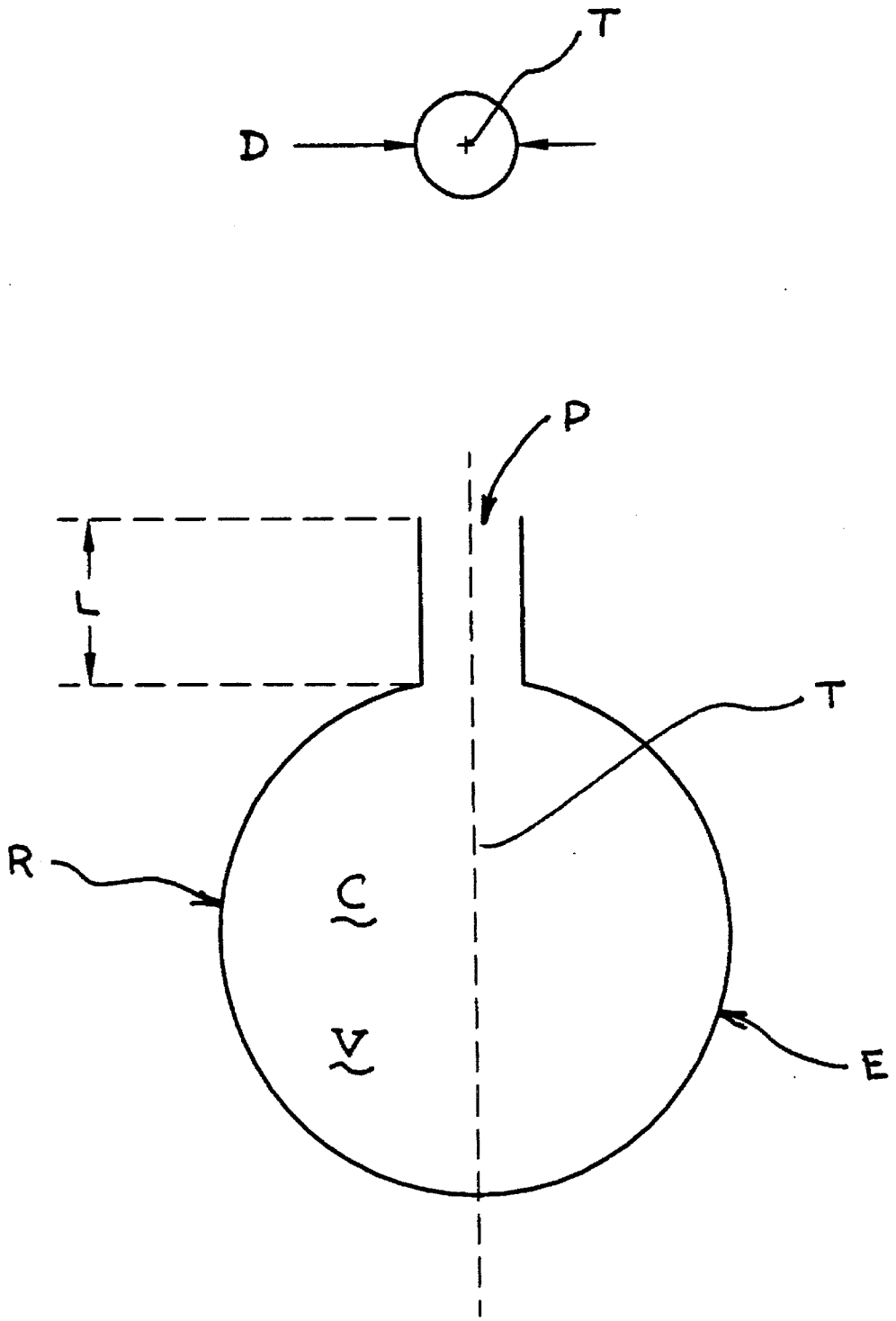
FIG. 1 PRIOR ART
FIG. 1 illustrates a Helmholtz resonator.

Afterwards the rigid exterior form is removed. This leaves the plastic resonator bulb, ending the first stage. Completed resonator bulbs may resemble light bulbs or Christmas tree ornaments as well as the resonator schematic in FIG. 1. A pre-formed resonator bulb can function in a stand-alone application. Bulbs embodied according to the invention are instead used as hollow interior forms which will withstand pressures exerted by concrete in the panel molding process.

Figure 2:
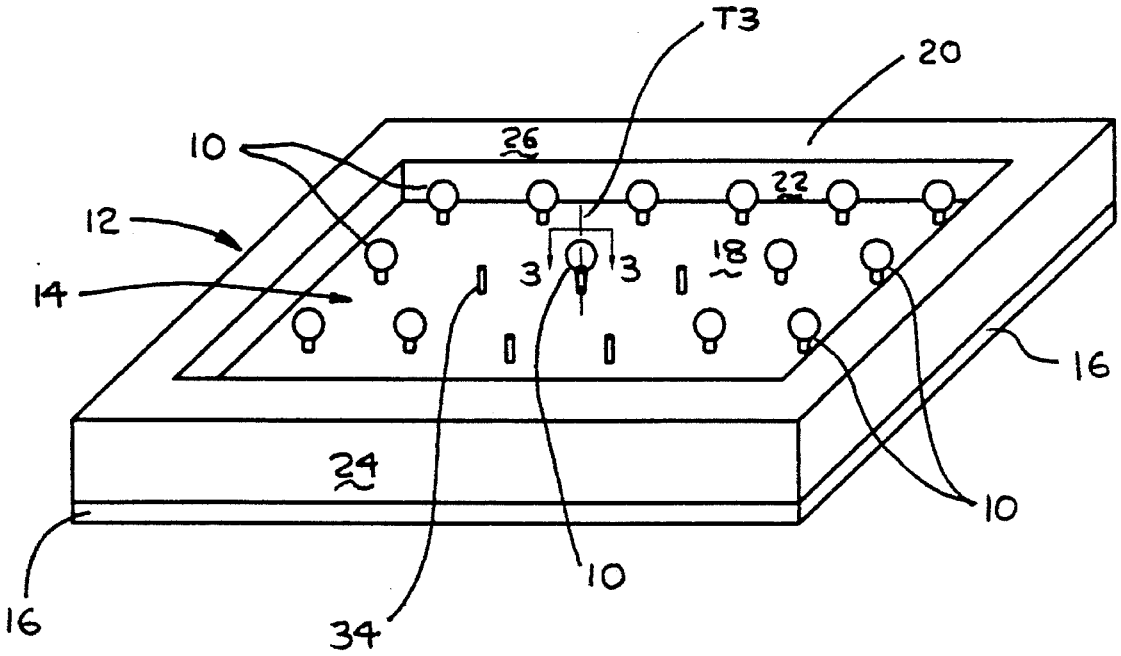
FIG. 2 is an isometric view of a jig form which defines a panel molding region for holding pre-formed resonator bulbs in a pattern with intervening spaces to be filled by concrete.

Referring to FIG. 2, after having pre-formed resonator bulb 10, the invention process advances to a second stage of molding, preferably using jig form 12. A resonator panel is molded using pre-formed resonator bulbs 10 and concrete together in panel molding region 14. Wood, metal, plastic or other suitable material embodies jig form 12. Base 16 has a horizontal upper surface floor 18 for forming a sound-receiving front face surface on concrete once poured in molding region 14. Frame 20 has a vertical inside surface border 22 around the periphery for forming an edge surface on the concrete. Frame 20 is a preferably rectangular with inside surface 22, outside surface 24 and top surface 26 of which the elevation determines the thickness of panels molded in jig form 12.

Figure 3:
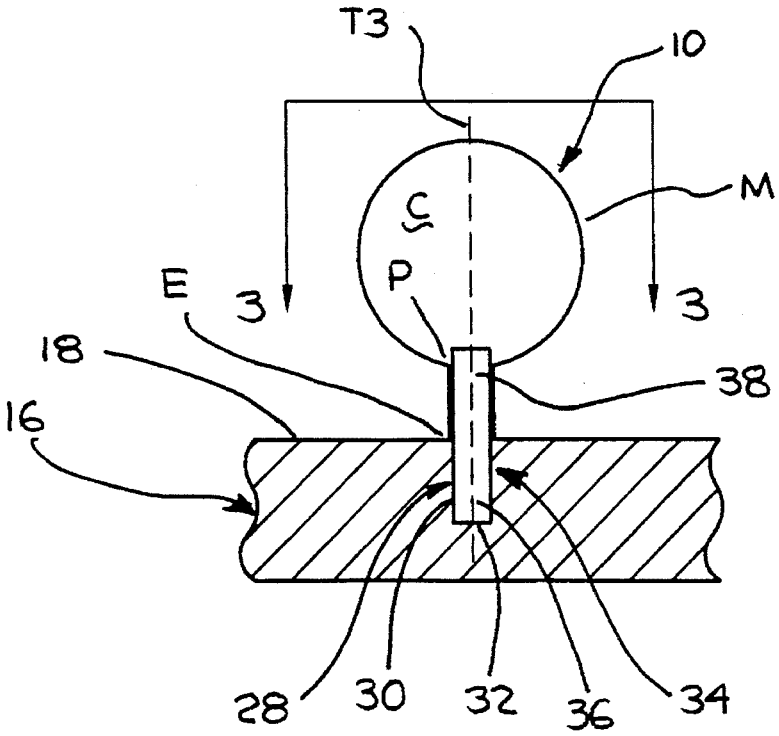
FIG. 3 shows a pre-formed bulb at a resonator location on axis T3 in a cross-section along plane 3—3 through the jig form of FIG. 2.

Referring to FIG. 3, the surface of floor 18 is generally flat except in resonator location areas which accommodate pre-formed resonator bulbs 10 as shown for example at axis T3 in a cross-section along vertical plane 3—3 taken from FIG. 2. Floor 18 at each resonator location has an anchor hole 28 surrounded by sidewall 30 descending to bottom 32.

Cylindrical pin 34 is made of a material as mentioned above. Lower end 36 is scaled for a friction fit into anchor hole 28. Pin 34 projects perpendicularly from surface 18 to an upper end 38 and is scaled to fit through the area A of the opening of port P of pre-formed resonator bulb 10. Pin 34 when fitted into port P aligns bulb 10 at a resonator location, possibly in a pattern as shown by FIG. 2. Pins 34 brace respective bulbs 10 against impact shock followed by turbulence of concrete being poured into molding region 14.

Concrete (not shown) filling jig form 12, afterwards while it sets, compresses bulbs 10. Tension increases in each bulb 10 causing minimal volume changes of its cavity C until the bulb wall tension counter-balances the weight of concrete. The equilibrium cavity volume is finalized when the concrete settling around the molding surface M outside bulb 10 is done.

Figure 4:
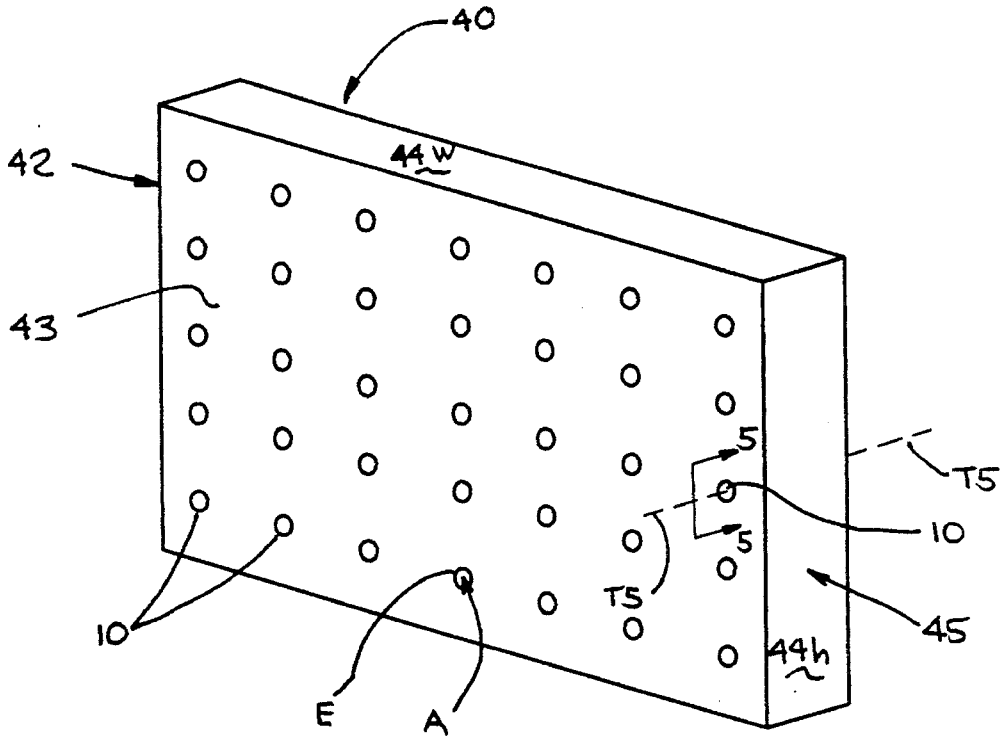
FIG. 4 is an isometric view of a resonator panel having a sound-receiving front face with port openings molded by pre-formed resonator bulbs.

Referring to FIG. 4, when the poured concrete dries, jig form 12 is removed, which leaves resonator panel embodiment 40 at the end of the second stage. The portion of concrete 42 which was molded horizontally on the floor 18 of jig form 12 now becomes the panel's vertically standing sound receiving front face surface 43 bounded by edges E around port areas A of openings of ports to bulbs 10 in an array corresponding to the resonator locations shown in FIG. 2. The edge surfaces 44h along the height and 44w along the width in the thickness dimension correspond to vertical inside surface border 22 of frame 20.

FIG. 5 shows an example bulb 10 in a cross-section along plane 5—5 inside panel 40 taken from FIG. 4 as seen along arrow 45. Bulb 10 has outer side molding surface M bounded by an edge E which circumscribes a port are A. Since hollow bulbs instead of conventional rigid solid interior forms were used, there are no solid form obstructions needing to be cleared from the resonator panel embodiment 40. After stiffening, concrete 42 reaches a final amount of compression of the resonator bulbs 10 which remain permanently inside panel 40. The surrounding concrete reinforces each bulb 10 against incidental shocks to resonator panel 40. The panel has the advantage of reducing the amount of concrete needed, as well as the weight of, the panel.

Notwithstanding that the invention has been disclosed in terms of its preferred embodiment, persons skilled in the art will appreciate that the embodiment could be modified. For example, the first stage can have resonator bulbs pre-formed by other than blow molding techniques. The second stage can have a jig form embodied by an assembly of more numerous subcomponents, or alternatively in a single piece monolithically molded with an integral base and pins. A further alternative embodiment can omit pins from the jig form for holding pre-formed resonator bulbs having outside surfaces dimensioned to fit into anchor holes. To insure against pre-formed resonator bulbs floating in liquid concrete, the anchor means can be supplemented. The preferred concrete medium can be replaced by a substitute medium. Certain selected media could pre-form bulbs in the first stage and then also be filled in between the bulbs in the second stage. This could merge the interface boundaries between them and even mold a monolithic panel.

Accordingly, the invention, to the extent of any such variations, is intended to be covered in interpreting the scope of the following claims.

I claim:

1. Sound panel means formed of:

a plurality of Helmholtz resonator bulb means, each comprising a first material with an outer side having a molding surface bounded by an edge which circumscribes a port area, and an inner side having a resonator surface bounded by said edge and recessed along an axis from said port area into said material, said plurality of resonator bulb means being disposed so that their respective port areas are separately coincident in a sound-receiving front face surface; and body means comprising a second material disposed between said sound-receiving front face surface and said molding surfaces.

2. Sound panel means as in claim 1 wherein said second material comprises concrete.

3. Sound panel means as in claim 1 wherein said first material comprises polymer plastic.

4. Sound panel means as in claim 1 wherein said first material comprises silica glass.

5. Sound panel means as in claim 1 wherein said plurality of resonator means have matching resonances.

6. Sound panel means as in claim 1 wherein said sound receiving front face surface is planar.

7. Sound panel means as in claim 1 wherein said resonator surface is radially symmetrical around said axis.

* * * * *